US006305138B1

(12) United States Patent
Stahl et al.

(10) Patent No.: US 6,305,138 B1
(45) **Date of Patent: *Oct. 23, 2001**

(54) COMPOSITE SHINGLE HAVING SHADING ZONES IN DIFFERENT PLANES

(75) Inventors: Kermit E. Stahl, North Wales; Michael J. Noone, Wayne; George W. Mehrer, Jenkintown, all of PA (US)

(73) Assignee: CertainTeed Corp., Valley Forge, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/690,978

(22) Filed: Oct. 18, 2000

Related U.S. Application Data

(63) Continuation of application No. 09/193,856, filed on Nov. 17, 1998, which is a continuation of application No. 08/853,657, filed on May 9, 1997, now Pat. No. 5,901,517, which is a continuation of application No. 08/386,953, filed on Feb. 10, 1995, now Pat. No. 5,660,014, which is a continuation of application No. 07/712,965, filed on Jun. 10, 1991, now Pat. No. 5,426,902, which is a continuation-in-part of application No. 07/515,253, filed on Apr. 27, 1990, now Pat. No. Des. 340,294, and a continuation-in-part of application No. 07/515,258, filed on Apr. 27, 1990, now Pat. No. Des. 336,347, and a continuation-in-part of application No. 07/515,601, filed on Apr. 27, 1990, now Pat. No. 5,181,361, said application No. 07/515,253, said application No. 07/515,258, said application No. 07/515,601, is a continuation-in-part of application No. 07/110,801, filed on Oct. 20, 1987, now Pat. No. Des. 314,628, and application No. 07/174,023, filed on May 28, 1998, now Pat. No. Des. 350,615, said application No. 07/712,965, is a continuation-in-part of application No. 07/570,722, filed on Aug. 22, 1990, now Pat. No. Des. 317,506, which is a division of application No. 07/174,022, filed on Mar. 28, 1988, now Pat. No. Des. 314,439.

(51) Int. Cl.[7] ..... B44F 7/00; B44F 9/00; E04C 1/00

(52) U.S. Cl. ..... 52/314; 52/316; 52/555; 52/557

(58) Field of Search ..... 52/314

(56) References Cited

U.S. PATENT DOCUMENTS

D. 48,172 11/1915 DunLany .
D. 51,438 10/1917 Carson .

(List continued on next page.)

*Primary Examiner*—Carl D. Friedman
*Assistant Examiner*—Chi Q Nguyen
(74) *Attorney, Agent, or Firm*—Paul & Paul

(57) ABSTRACT

A laminated shingle is provided, having lighter and darker granule portions visible from the front, at different planes; the front-most or anterior plane generally having granules of lighter shading and the more rearward or posterior plane generally having darker granules. The darker granules in the more posterior plane are visible from the front of the shingle to provide visually sharp, precise delineation between zones of lighter and darker shading. The shingles may be of multi-layer construction with suitable adhesives securing the layers together. The darker granules may be visible from beneath the lower edge(s) of the anterior shingle, to provide a shadow line effect. Alternatively, or in addition thereto, the darker shingle zones from the more posterior plane may be visible through tab-separating slots of the lighter shaded anterior shingle portion.

18 Claims, 2 Drawing Sheets

U.S. PATENT DOCUMENTS

| | | |
|---|---|---|
| D. 83,704 | 3/1931 | Stark . |
| D. 313,278 | 12/1990 | Noone . |
| D. 313,658 | 1/1991 | Noone . |
| D. 314,439 | 2/1991 | Jenkins et al. . |
| D. 314,628 | 2/1991 | Jenkins et al. . |
| D. 317,506 | 6/1991 | Jenkins et al. . |
| D. 326,330 | 5/1992 | Klein . |
| D. 336,347 | 6/1993 | Hannah et al. . |
| D. 340,294 | 10/1993 | Hannah et al. . |
| D. 344,144 | 2/1994 | Weaver et al. . |
| D. 350,615 | 9/1994 | Klein et al. . |
| 1,154,334 | 9/1915 | Overbury . |
| 1,208,595 | 12/1916 | McKay . |
| 1,345,627 | 7/1920 | Overbury . |
| 1,351,181 | 8/1920 | McKay . |
| 1,368,947 | 2/1921 | Levis . |
| 1,583,563 | 5/1926 | Abraham . |
| 1,593,095 | 7/1926 | Munro . |
| 1,601,731 | 10/1926 | Flood . |
| 1,629,287 | 5/1927 | Milligan . |
| 1,748,981 | 3/1930 | Harris . |
| 1,791,571 | 2/1931 | Overbury . |
| 1,802,868 | 4/1931 | Black . |
| 1,873,944 | 8/1932 | Black . |
| 1,898,989 | 2/1933 | Harshberger . |
| 1,924,650 | 8/1933 | Payne . |
| 1,958,560 | 5/1934 | Beckman . |
| 2,045,423 | 6/1936 | Topping . |
| 2,085,899 | 7/1937 | Chamberlain . |
| 2,096,968 | 10/1937 | Johnston . |
| 2,196,847 | 4/1940 | Austin . |
| 2,197,972 | 4/1940 | Ernst . |
| 2,199,760 | 5/1940 | Schuetz . |
| 2,205,679 | 6/1940 | Ames, Jr. . |
| 2,206,915 | 7/1940 | Ochs . |
| 2,253,652 | 8/1941 | Ritter . |
| 2,335,493 | 11/1943 | Drinkall . |
| 2,661,303 | 12/1953 | Fasold et al. . |
| 3,166,872 | 1/1965 | Cacossa . |
| 3,377,762 | 4/1968 | Chalmers et al. . |
| 3,468,092 | 9/1969 | Chalmers . |
| 3,484,267 | 12/1969 | Sadler, III . |
| 3,613,328 | 10/1971 | Morgan, Jr., et al. . |
| 3,624,975 | 12/1971 | Morgan et al. . |
| 3,919,823 | 11/1975 | Bradley . |
| 3,921,358 | 11/1975 | Bettoli . |
| 4,274,243 | 6/1981 | Corbin et al. . |
| 4,322,928 | 4/1982 | Freiborg . |
| 4,468,909 | 9/1984 | Eaton . |
| 5,375,387 | 12/1994 | Davenport . |
| 5,426,902 | 6/1995 | Stahl et al. . |
| 5,901,517 * | 5/1999 | Stahl et al. ..... 52/314 |

* cited by examiner

COMPOSITE SHINGLE HAVING SHADING ZONES IN DIFFERENT PLANES

CROSS-REFERENCE TO RELATED APPLICATIONS

This is a continuation of U.S. application Ser. No. 09/193,856 filed Nov. 17, 1998, which is a continuation of 08/853,657, filed May 9 1997, now U.S. Pat. No. 5,901,517, which is a continuation of U.S. application Ser. No. 08/386,953, filed Feb. 10, 1995, now U.S. Pat. No. 5,660,014, which is a continuation of U.S. application Ser. No. 07/712,965, filed Jun. 10 1991, now U.S. Pat. No. 5,426,902 which is a continuation-in-part of application 07/515,253, filed Apr. 27, 1990, now Patent D340,294 and a continuation-in-part of application Ser. No. 07/515,258, filed Apr. 27, 1990 now Patent D336,347 and a continuation-in-part of application Ser. No. 07/515,601, filed Apr. 27, 1990, now U.S. Pat. No. 5,181,361. Said applications. Ser. Nos. 07/515,253, 07/515,258 and 07/515,601 are each continuations-in-part of application Ser. No. 07/110,801, filed Oct. 20, 1987 now Patent D314,628 and application Ser. No. 07/174,023, filed Mar. 28, 1988, now Patent D350,615. Application Ser. No. 07/712,965 is a continuation-in-part of application Ser. No. 07/570,722, filed Aug. 22, 1990, now Patent D317,506, which is a division of application Ser. No. 07/174,022, filed Mar. 28 1998, now Patent D314,439.

SUMMARY OF THE INVENTION

A composite, laminated shingle is provided having layers of granules at different planes, with the granules in the more posterior plane being darker than those in the more anterior plane, to yield zones of different shading. The edges of the granules in the anterior plane, which are on a different shingle layer than those of the granules in the posterior plane, provide visually sharp, precise delineation between zones of lighter and darker shadings. The darker shadings may preferably be provided below the lower edges of the shingle layer having the lighter granules, and/or through tab-separating slots in such anterior shingle layer.

BACKGROUND OF THE INVENTION

The present invention is directed to a multi-layer shingle, Preferably one constructed of asphaltic roofing material, and most particularly one having an asphaltic material provided over a base mat, which then has granules applied to surfaces thereof.

The art of shingle manufacture is highly developed, and improvements in shingle manufacturing have been subtle, often being devoted to the simulation of wood or other natural appearing shingles, having natural appearing textures.

In the course of shingle development, some approaches have been toward applying granules of various color and shading configurations.

The present invention is directed toward providing a multi-layer shingle, of at least two layers, having areas of different shading, at different depths or planes, whereby the visual contrast, upon viewing a shingle from the front, is of sharp, precise delineation between the zones caused by edges of the anterior shingle layer of one shading overlying portions of a posterior shingle layer of a different shading.

Accordingly, it is a primary object of this invention to provide a multi-layer shingle having sharp, precise delineation between zones of different shadings.

It is another object of this invention to accomplish the above object, by the use of anterior and posterior shingle layers having granules of different shadings in different planes.

Other objects and advantages of the present invention will be readily apparent to those skilled in the art from a reading of the following brief descriptions of the drawing figures, detailed Descriptions of the preferred embodiments and the appended

BRIEF DESCRIPTIONS OF THE DRAWING FIGURES

DETAILED DESCRIPTIONS OF THE PREFERRED EMBODIMENTS

Figure 1:
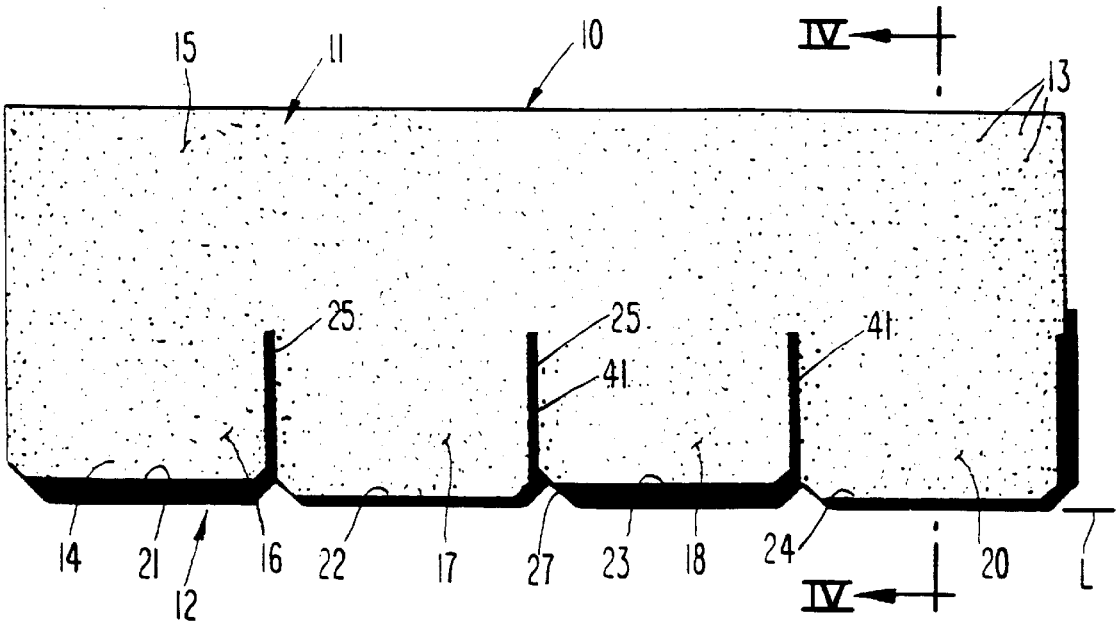
FIG. 1 is a front view of a composite shingle in accordance with this invention.

Referring now to the drawings in detail, reference is first made to FIG. 1, wherein a shingle, generally designated by the numeral 10, is shown. The shingle 10 comprises an anterior layer 11 and a posterior layer 12, secured together by a suitable adhesive substance, located therebetween. The anterior layer 11, or the layer which is viewed principally from the front when the shingle is in an installed condition, is comprised of a suitable mat of fiberglass or other construction that is permeated with a preferably asphaltic substance, and with a plurality of granules 13 dispersed over the front surface 14, and held there against by the adhesive characteristics of the asphalt comprising the surface 14 beneath the granules 13. The shingle layer 11 has an upper portion 15 and a plurality of tab portions 16, 17, 18 and 20. The tab portions 16, 17, 18 and 20 are shown having different levels of downward extension for their lower edges 21–24, respectively, but it will be understood that shingle tabs may vary in this respect, to have a common lower edge, different shapes for their lower edges, or all be identical and at different levels of extension, as may be desired. Where the shingle layer is to be divided into tabs, there will generally be one or more slots 25 extending completely through the anterior layer 11, as shown. The lower ends of the shingles may have suitable aesthetic indentations or notches such as that 27, as may be desired.

The lower edge of the posterior layer 12, to which the granule layer 33 extends, defines a straight line "L", although the line L may be interrupted by interruptions therein, such as the notches 27. The straight edge formed by the line L provides a number of advantages. One such advantage is in the application of shingles to a roof, where the workman applying the shingle may utilize the generally straight line L as a guide in applying the shingles in a straight line, one next to the other, and even in applying successive courses, one over the other. Another advantage of the straight line L resides in facilitating packaging of shingles, wherein stacks of shingles will have a generally common edge, for vertically aligning shingles in a stack. A third advantage resides in the ability to have the anterior layer 11 assume various diverse configurations at its lower end, vet remain protected, because the lower edge of the anterior layer is set back, or above the lower edge of the posterior layer that provides the protection.

Figure 2:
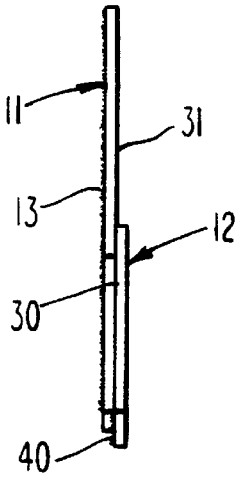
FIG. 2 is a right end view of the shingle of FIG. 1.

With reference as well to FIG. 2, it will be seen that the posterior layer 12 may be of substantially half height, as shown, to be disposed such that its front surface is against the rear surface 31 of the anterior layer 11, as shown.

Figure 4:
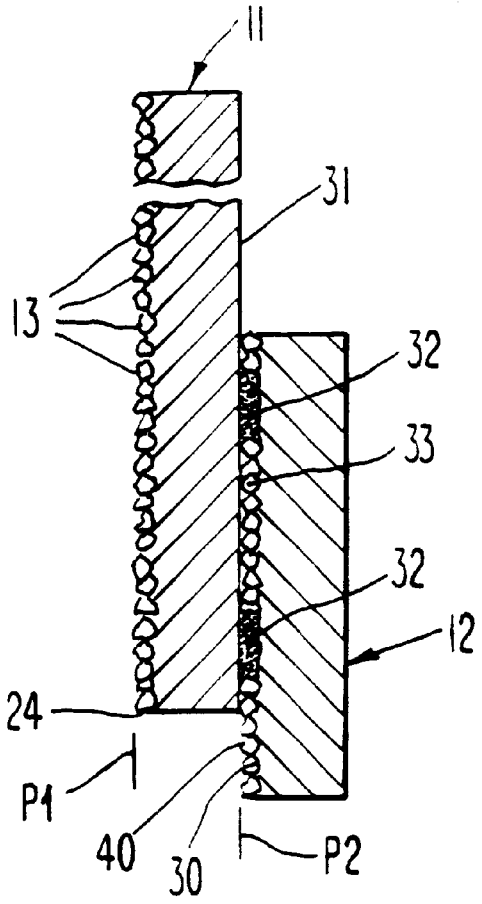
FIG. 4 is an enlarged fragmentary, schematic, cross-sectional view of the shingle of FIG. 1 taken generally along the line IV—IV of FIG. 1.

With specific reference to FIG. 4, it will be seen that a plurality of adhesive strips 32 are provided, embedded in the granule layer 33 that is on the front surface of the posterior layer 12, connecting the front surface 30 of posterior layer 12 to the rear surface 31 of the anterior layer 11, in an adhesive-secured manner. The adhesive strips 33 are also preferably constructed of an asphaltic substance.

Figure 6:
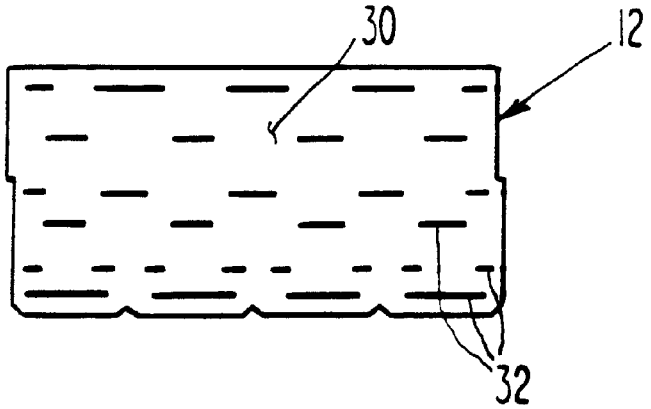
FIG. 6 is a schematic view of a posterior shingle layer, with zones of adhesive application.

With specific reference to FIG. 6, there is shown a pattern of arrangement for adhesive strips 32, on the front surface 30 of the posterior layer 12.

With specific reference to FIG. 4, it will be seen that the granule layers 13 and 33 are disposed at different spaced-apart planes P1 and P2, respectively.

It will also be apparent that the darker granule zones such as those 40 extending below and visible beneath a lower tab edge 24 of the anterior layer 11, as well as those 41 visible through slots 25, are uncovered by the anterior shingle layer 11 such that the darker granules disposed thereon are seen in marked contrast to the lighter granules 15 on the front surface of the anterior layer 11, such that the edges of the slots 25 in the anterior layer, and the edges 2, 22, 23 and 24 at the lower ends of,the tabs form a visually sharp, precise delineation between zones of lighter and darker shadings. It will be apparent that, while only two different shading zones are shown in the illustration of FIG. 1; one lighter and one darker, various modifications and arrangements may be made. For example, on the front surface of the layer 11, a plurality of different lighter shading zones may be utilized. Similarly, on the front surface of the posterior layer 12, a plurality of different darker shading zones maybe utilized. In lieu of different levels of lightness or darkness of the various shading zones discussed, or in addition thereto, the various shading zones may simply be zones of different colors, all within the spirit and scope of this invention.

It will also be apparent that the granules may be of different types and selections, to yield different shading, sizing, and/or color arrangements.

Figure 3:
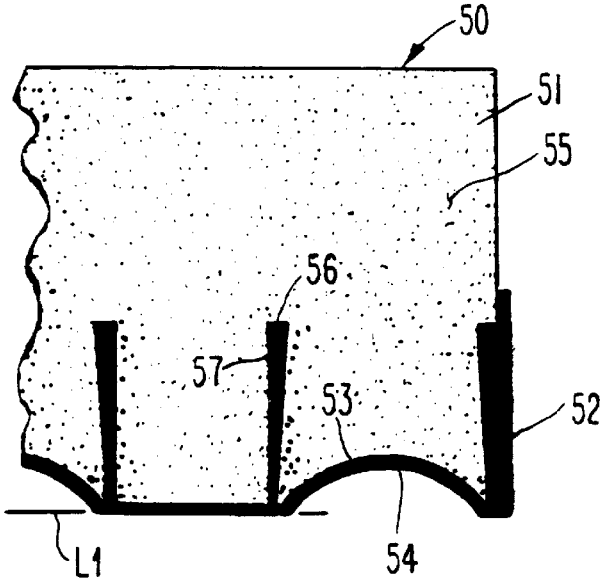
FIG. 3 is a fragmentary view of an alternative embodiment of a shingle in accordance with this invention, in which the zones of darker shading have a different configuration than the zones of darker configuration for the shingle of FIG. 1.

With reference to FIG. 3, it will be seen that a representative alternative design may be made, utilizing a shingle 50 having an anterior layer 51 and a posterior layer 52, wherein the lower edge 53 of the anterior layer has a particular design configuration, beneath which is visible a particular design configuration for the darker edge extension of the layer 52, and at a plane spaced-apart from the front surface 55 of the anterior layer 51, in much he same manner as the relative spacings of planes P1 and P2 of FIG. 4. Similarly, the visibility of portions of a darker layer of granules 56 from the front surface of posterior layer 52 is apparent through the slots 57, configured in a different arrangement for the embodiment of FIG. 3. The lower edge of the posterior layer of the shingle of FIG. 3 terminates in a straight line L1 for the same reasons as are set forth above for the shingle of FIG. 1, although the same may be interrupted as shown or in any other design.

Figure 5:
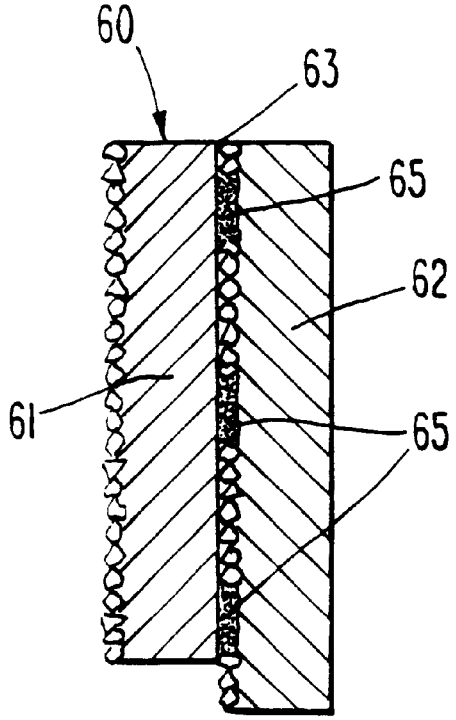
FIG. 5 is a view similar to that of FIG. 4, but wherein the posterior shingle layer is of full height.

With specific reference to FIG. 5, there is shown another alternative embodiment for a shingle 60, in which an anterior layer 61 has a posterior layer 62 that is of such a height that it substantially covers all of the rear surface 63 of the layer 62, as shown, being suitably secured thereto by adhesive zones 65, similar to those discussed above with reference to the embodiment of FIG. 4.

It will be apparent from the foregoing that various modifications may be made in the details of construction, as well as in the use and operation of the present invention all within the spirit and scope of the invention as claimed.

What is claimed is:

1. A composite laminated, multi-tab shingle for roofing or the like comprising:

(a) an anterior shingle layer having front and rear surfaces between edges thereof; with the front surface having a layer of granules thereon comprising at least one visible portion, of a first lighter shading;

(b) a posterior shingle layer having front and rear surfaces between edges thereof;

(c) with substantial portions of the front surface of the posterior shingle layer being covered by the anterior shingle layer;

(d) with the posterior shingle layer having visible front surface portions that are uncovered by the anterior shingle layer;

(e) with the visible front surface portions of the posterior shingle layer being at a posterior plane relative to the plane of the front surface of the anterior shingle layer and comprising at least one portion of a second, darker shading than said first shading; and (f) with some portions of the anterior shingle layer having lower edges that extend lower than lower edges of other portions of the anterior shingle layer.

2. The shingle of claim 1, with edges of said anterior shingle layer comprising visually sharp, precise delineation between portions of lighter and darker shadings.

3. The shingle of claim 2, wherein an adhesive substance is provided between the front surface of the posterior shingle layer and the rear surface of the anterior shingle layer, comprising means adhesively securing said layers together.

4. The shingle of claim 3, wherein said adhesive substance is provided in the form of a plurality of strips.

5. The shingle of claim 2, wherein the shingle layers each have upper and lower edges, and wherein the visible front surface portions of the posterior shingle layer extend below the lower edges of the anterior shingle layer.

6. The shingle of claim 2, wherein the anterior shingle layer has upper and lower edges and slots extending into the layer from a lower edge thereof, and wherein the visible front surface portions of the posterior shingle layer are disposed behind, and are visible through, said slots.

7. The shingle of claim 2, with edges of said anterior shingle layer comprising visually sharp, precise delineation between zones of lighter and darker shadings; wherein the shingle layers each have upper and lower edges, and wherein the visible front surface portions of the posterior shingle layer extend below the lower edges of the anterior shingle layer; and wherein the anterior shingle layer has upper and lower edges and slots extending into the layer from a lower edge thereof, and wherein the visible front surface portions of the posterior shingle layer are disposed behind, and are visible through, said slots.

8. The shingle of claim 7, wherein an adhesive substance is provided between the front surface of the posterior shingle layer and the rear surface of the anterior shingle layer, comprising means adhesively securing said layers together.

9. The shingle of claim 2, wherein the posterior shingle layer extends behind, and is in engagement against, substantially the lower half of the rear surface of the anterior shingle layer.

10. The shingle of claim 2, wherein the posterior shingle layer extends behind, and is in engagement against, substantially the entirety of the rear surface of the anterior shingle layer.

11. The shingle of claim 1, wherein the lower end of the posterior shingle layer comprises a straight line, irrespective of any interruptions therein.

12. The shingle of claim 3, wherein the anterior shingle layer has a plurality of slots dividing portions of the anterior shingle layer adjacent the slots into tabs, with anterior notches disposed in the tabs of the anterior layer at lower ends of the slots, with posterior notches disposed in the posterior layer lower than associated said slots, and with at least some of the notches in the posterior layer being laterally offset relative to notches in the anterior layer associated with the same slots.

13. The shingle of claim 2, wherein the shingle layers each have upper and lower edges, and wherein the visible front surface portions of the posterior shingle layer extend below the lower edges of the anterior shingle layer; and wherein the anterior shingle layer has upper and lower edges and slots extending into the layer from a lower edge thereof, and wherein the visible front surface portion of the posterior shingle layer are disposed behind, and visible through, said slots.

14. The shingle of claim 6, wherein the visible front surface portion of the posterior shingle layer that are visible through said slots in said anterior shingle layer, are free of slots extending into said posterior shingle layer.

15. The shingle of claim 1, wherein the anterior shingle layer has upper and lower edges and slots extending into the layer from a lower edge thereof, and wherein the visible front surface portions of the posterior shingle are disposed behind, and are visible through, said slots; wherein the visible front surface portions of the posterior shingle layer that are visible through said slots in said anterior shingle layer are free of slots extending into said posterior shingle layer.

16. The shingle of claim 1, wherein there is a layer of granules on the visible front surface portions of the posterior shingle layer.

17. A composite laminated, multi-tab shingle for roofing or the like comprising:

(a) an anterior shingle layer having front and rear surfaces between edges thereof; with the front surface having a layer of granules thereon comprising at least one visible portion of a first shading;

(b) a posterior shingle layer having front and rear surfaces between edges thereof;

(c) with substantial portions of the front surface of the posterior shingle layer being covered by the anterior shingle layer;

(d) with the posterior shingle layer having visible front surface portions that are uncovered by the anterior shingle layer;

(e) with the visible front surface portions of the posterior shingle layer being at a posterior plane relative to the plane of the front surface of the anterior shingle layer and comprising at least one portion of a second, different shading than said first shading; and (f) with some portions of the anterior shingle layer having lower edges that extend lower than lower edges of other portions of the anterior shingle layer.

18. The shingle of claim 17, wherein the shingle has a lower tab portion and an upper portion above the tab portion, and wherein substantial portions of the rear surface of the anterior shingle layer in the upper portion of the shingle are free of any posterior shingle layer portion disposed thereagainst.

* * * * *

UNITED STATES PATENT AND TRADEMARK OFFICE

CERTIFICATE OF CORRECTION

PATENT NO. : 6,305,138 B1
DATED : October 23, 2001
INVENTOR(S) : Stahl et al.

It is certified that error appears in the above-identified patent and that said Letters Patent is hereby corrected as shown below:

Column 2,
Line 4, please delete "Descriptions" and replace with -- descriptions --.
Line 5, please add the word -- claims -- after the word "appended".
Line 39, please delete "there against" and replace with -- against there --.

Column 3,
Line 29, please delete "2" and replace with -- 21 --.
Line 54, please delete "he" and replace with -- the --.

Signed and Sealed this

Seventh Day of May, 2002

*Attest:*

*Attesting Officer*

JAMES E. ROGAN
*Director of the United States Patent and Trademark Office*